US011283174B2

(12) United States Patent
Cho et al.

(10) Patent No.: US 11,283,174 B2
(45) Date of Patent: Mar. 22, 2022

(54) ANTENNA

(71) Applicant: SAMSUNG ELECTRO-MECHANICS CO., LTD., Suwon-si (KR)

(72) Inventors: Sangik Cho, Suwon-si (KR); Ju Ho Kim, Suwon-si (KR)

(73) Assignee: SAMSUNG ELECTRO-MECHANICS CO., LTD.

( * ) Notice: Subject to any disclaimer, the term of this patent is extended or adjusted under 35 U.S.C. 154(b) by 0 days.

(21) Appl. No.: 16/905,324

(22) Filed: Jun. 18, 2020

(65) Prior Publication Data

US 2021/0320416 A1 Oct. 14, 2021

(30) Foreign Application Priority Data

Apr. 14, 2020 (KR) ..... 10-2020-0045140

(51) Int. Cl.
*H01Q 9/04* (2006.01)
*H01Q 1/12* (2006.01)
*H01Q 21/06* (2006.01)

(52) U.S. Cl.
CPC ..... *H01Q 9/0407* (2013.01); *H01Q 1/12* (2013.01); *H01Q 21/065* (2013.01)

(58) Field of Classification Search
CPC ..... H01Q 9/04; H01Q 9/0407; H01Q 9/0414; H01Q 9/045; H01Q 9/0457; H01Q 9/0485; H01Q 5/10; H01Q 5/378; H01Q 5/385; H01Q 1/12; H01Q 1/422; H01Q 21/06; H01Q 21/061; H01Q 21/065
See application file for complete search history.

(56) References Cited

U.S. PATENT DOCUMENTS

| | | | | |
|---|---|---|---|---|
| 9,496,596 | B2 | 11/2016 | Chirila | |
| 2016/0020165 | A1 | 1/2016 | Kamgaing et al. | |
| 2016/0056544 | A1* | 2/2016 | Garcia | H01Q 21/28 343/725 |
| 2016/0079672 | A1* | 3/2016 | Cerreno | H01Q 21/065 343/848 |
| 2018/0053983 | A1* | 2/2018 | Mukai | H01P 3/08 |
| 2018/0090816 | A1* | 3/2018 | Mow | H01Q 1/22 |
| 2018/0159213 | A1* | 6/2018 | Haziza | H01Q 21/065 |

(Continued)

FOREIGN PATENT DOCUMENTS

KR 10-2016-0130290 A 11/2016

*Primary Examiner* — Jason Crawford
(74) *Attorney, Agent, or Firm* — Morgan, Lewis & Bockius LLP

(57) ABSTRACT

An antenna includes a first dielectric layer having a first surface and a second surface opposing the first surface; a second dielectric layer having a third surface, and a fourth surface opposing the third surface; a third dielectric layer having a fifth surface and a sixth surface opposing the fifth surface; a first adhesive layer disposed between the second surface and the third surface; a second adhesive layer disposed between the fourth surface and the fifth surface; a patch pattern disposed on the second surface and embedded in the first adhesive layer; a first coupling pattern disposed on the fourth surface and embedded in the second adhesive layer, and a second coupling pattern disposed on the sixth surface. The patch pattern, the first coupling pattern, and the second coupling pattern at least partially overlap one another on a plane.

19 Claims, 8 Drawing Sheets

(56) References Cited

U.S. PATENT DOCUMENTS

| | | | | |
|---|---|---|---|---|
| 2020/0067165 | A1* | 2/2020 | Rogers | H01P 11/003 |
| 2020/0067191 | A1* | 2/2020 | Rogers | H01P 3/08 |
| 2020/0067201 | A1* | 2/2020 | Rogers | H01P 11/002 |
| 2020/0212537 | A1* | 7/2020 | Chuang | H01Q 9/0407 |
| 2020/0235478 | A1* | 7/2020 | Kitamura | H05K 3/3415 |
| 2021/0028548 | A1* | 1/2021 | Tsutsumi | H01Q 13/10 |
| 2021/0175609 | A1* | 6/2021 | Ryoo | H01Q 1/2283 |
| 2021/0320416 | A1* | 10/2021 | Cho | H01Q 9/0407 |
| 2021/0320421 | A1* | 10/2021 | Cho | H01Q 21/065 |
| 2021/0320426 | A1* | 10/2021 | Cho | H01Q 21/065 |

* cited by examiner

ANTENNA

CROSS-REFERENCE TO RELATED APPLICATION(S)

This application claims benefit of priority to Korean Patent Application No. 10-2020-0045140 filed on Apr. 14, 2020 in the Korean Intellectual Property Office, the disclosure of which is incorporated herein by reference in its entirety.

BACKGROUND

The present disclosure relates to an antenna, and more particularly, to a chip-type patch antenna.

As a communications technique of portable terminal devices has been developed from 4G to 5G, a band used for communications has been designed to be wire-range and multi-band. As mmWave is used, a physical size of a receiver should be decreased, and an antenna used in a portable terminal device should have increased efficiency to implement a wideband, and a reduced size has been required.

SUMMARY

An aspect of the present disclosure is to provide an antenna which may improve efficiency and may have a reduced size.

Another aspect of the present disclosure is to provide an antenna which may cover a radio frequency band.

Another aspect of the present disclosure is to provide an antenna which may increase matching properties between patterns formed on different layers.

According to an aspect of the present disclosure, an antenna may be implemented by configuring a body to include a plurality of dielectric layers and a plurality of adhesive layers disposed among the plurality of dielectric layers through a layering process, rather than a matching process, and forming a required number of a patch pattern and a coupling pattern in the body.

For example, according to an aspect of the present disclosure, an antenna may include a first dielectric layer having a first surface and a second surface opposing the first surface; a second dielectric layer having a third surface, and a fourth surface opposing the third surface; a third dielectric layer having a fifth surface and a sixth surface opposing the fifth surface; a first adhesive layer disposed between the second surface and the third surface; a second adhesive layer disposed between the fourth surface and the fifth surface; a patch pattern disposed on the second surface and embedded in the first adhesive layer; a first coupling pattern disposed on the fourth surface and embedded in the second adhesive layer, and a second coupling pattern disposed on the sixth surface. The patch pattern, the first coupling pattern, and the second coupling pattern at least partially overlap one another on a plane.

For example, according to an aspect of the present disclosure, an antenna may include a body portion including a plurality of dielectric layers, and a plurality of adhesive layers disposed among the plurality of dielectric layers; and a pattern portion including a patch pattern disposed in the body and one or more coupling patterns disposed in or on the body portion. Each of an uppermost dielectric layer and a lowermost dielectric layer of the plurality of dielectric layers has a dielectric constant greater than a dielectric constant of an internal dielectric layer of the plurality of dielectric layers disposed between the uppermost dielectric layer and the lowermost dielectric layer.

For example, according to an aspect of the present disclosure, an antenna may include a body portion including dielectric layers and adhesive layers disposed alternately disposed; a pattern portion including a patch pattern protruding from a first surface of one of the dielectric layers and embedded in one of the adhesive layers, and one or more coupling patterns respectively disposed on one or more of the dielectric layers; a pad pattern protruding from a second surface of the one of the dielectric layers opposing the first surface; and a through-via disposed in the one of the dielectric layers and connecting the patch pattern to the pad pattern.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
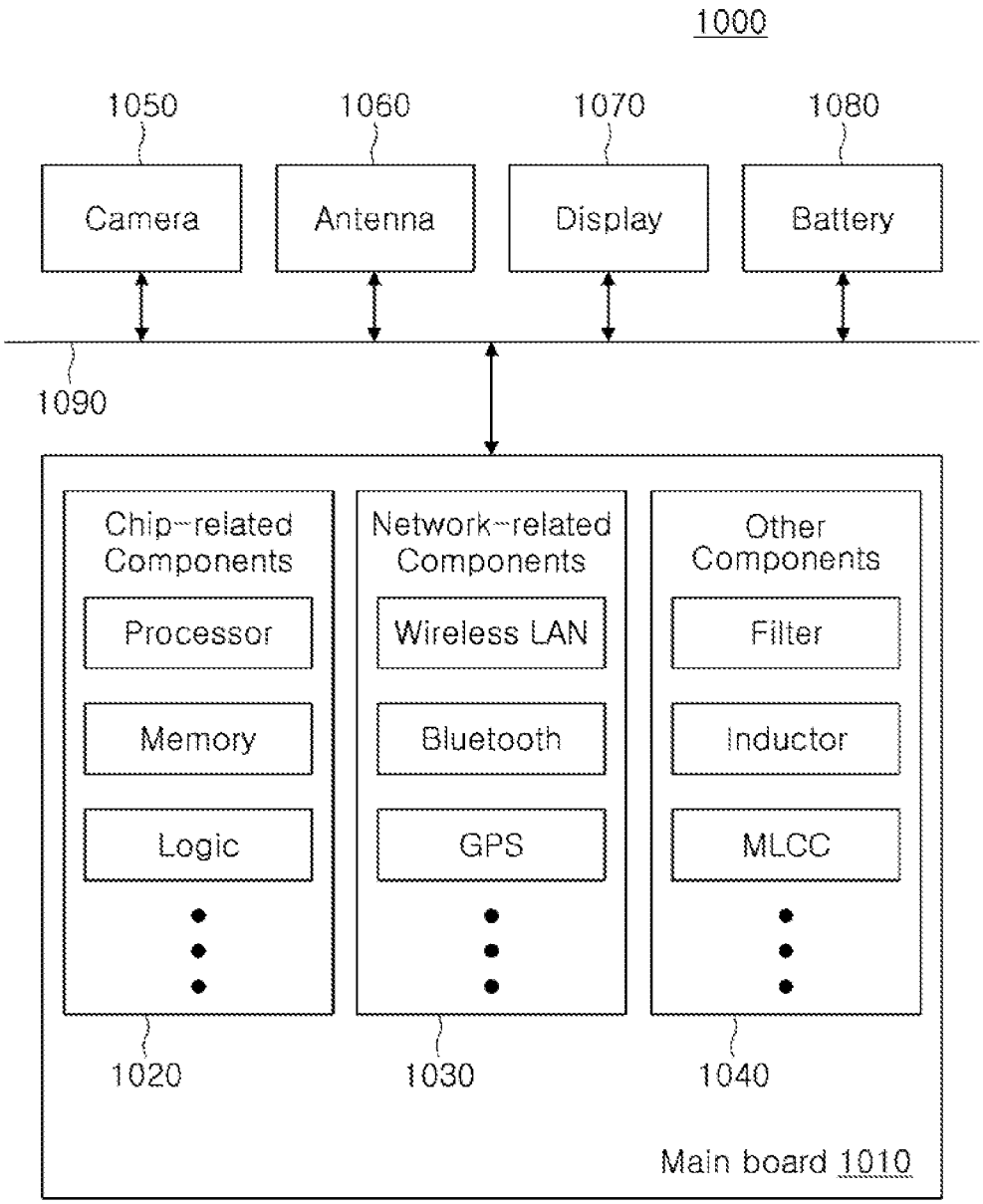
FIG. 1 is a block diagram illustrating an example of an electronic device system.

Hereinafter, example embodiments of the present disclosure will be described with reference to the accompanying drawings. In the drawings, shapes, sizes, and the like, of elements may be exaggerated or briefly illustrated for clarity of description.

FIG. 1 is a block diagram illustrating an example of an electronic device system.

Referring to FIG. 1, an electronic device 1000 may accommodate a mainboard 1010 therein. The mainboard 1010 may include chip related components 1020, network related components 1030, other components 1040, and the like, physically or electrically connected thereto. These components may be connected to others to be described below to form various signal lines 1090.

The chip related components 1020 may include a memory chip such as a volatile memory (for example, a dynamic random access memory (DRAM)), a non-volatile memory (for example, a read only memory (ROM)), a flash memory, or the like; an application processor chip such as a central processor (for example, a central processing unit (CPU)), a graphics processor (for example, a graphics processing unit (GPU)), a digital signal processor, a cryptographic processor, a microprocessor, a microcontroller, or the like; and a logic chip such as an analog-to-digital (ADC) converter, an application-specific integrated circuit (ASIC), or the like. However, the chip related components 1020 are not limited thereto, but may also include other types of chip related components. In addition, the chip related components 1020 may be combined with each other.

The network related components 1030 may include protocols such as wireless fidelity (Wi-Fi) (Institute of Electrical And Electronics Engineers (IEEE) 802.11 family, or the like), worldwide interoperability for microwave access (WiMAX) (IEEE 802.16 family, or the like), IEEE 802.20, long term evolution (LTE), evolution data only (Ev-DO), high speed packet access+(HSPA+), high speed downlink packet access+(HSDPA+), high speed uplink packet access+(HSUPA+), enhanced data GSM environment (EDGE), global system for mobile communications (GSM), global positioning system (GPS), general packet radio service (GPRS), code division multiple access (CDMA), time division multiple access (TDMA), digital enhanced cordless telecommunications (DECT), Bluetooth, 3G, 4G, and 5G protocols, and any other wireless and wired protocols, designated after the abovementioned protocols. However, the network related components 1030 are not limited thereto, but may also include a variety of other wireless or wired standards or protocols. In addition, the network related components 1030 may be combined with each other, together with the chip related components 1020 described above.

Other components 1040 may include a high frequency inductor, a ferrite inductor, a power inductor, ferrite beads, a low temperature co-fired ceramic (LTCC), an electromagnetic interference (EMI) filter, a multilayer ceramic capacitor (MLCC), or the like. However, other components 1040 are not limited thereto, but may also include passive components used for various other purposes, or the like. In addition, other components 1040 may be combined with each other, together with the chip related components 1020 or the network related components 1030 described above.

Depending on a type of the electronic device 1000, the electronic device 1000 may include other components that may or may not be physically or electrically connected to the mainboard 1010. These other components may include, for example, a camera module 1050, an antenna 1060, a display device 1070, a battery 1080, an audio codec (not illustrated), a video codec (not illustrated), a power amplifier (not illustrated), a compass (not illustrated), an accelerometer (not illustrated), a gyroscope (not illustrated), a speaker (not illustrated), a mass storage unit (for example, a hard disk drive) (not illustrated), a compact disk (CD) drive (not illustrated), a digital versatile disk (DVD) drive (not illustrated), or the like. However, these other components are not limited thereto, but may also include other components used for various purposes depending on a type of electronic device 1000, or the like.

The electronic device 1000 may be a smartphone, a personal digital assistant (PDA), a digital video camera, a digital still camera, a network system, a computer, a monitor, a tablet PC, a laptop PC, a netbook PC, a television, a video game machine, a smartwatch, an automotive component, or the like. However, the electronic device 1000 is not limited thereto, but may be any other electronic device processing data.

Figure 2:
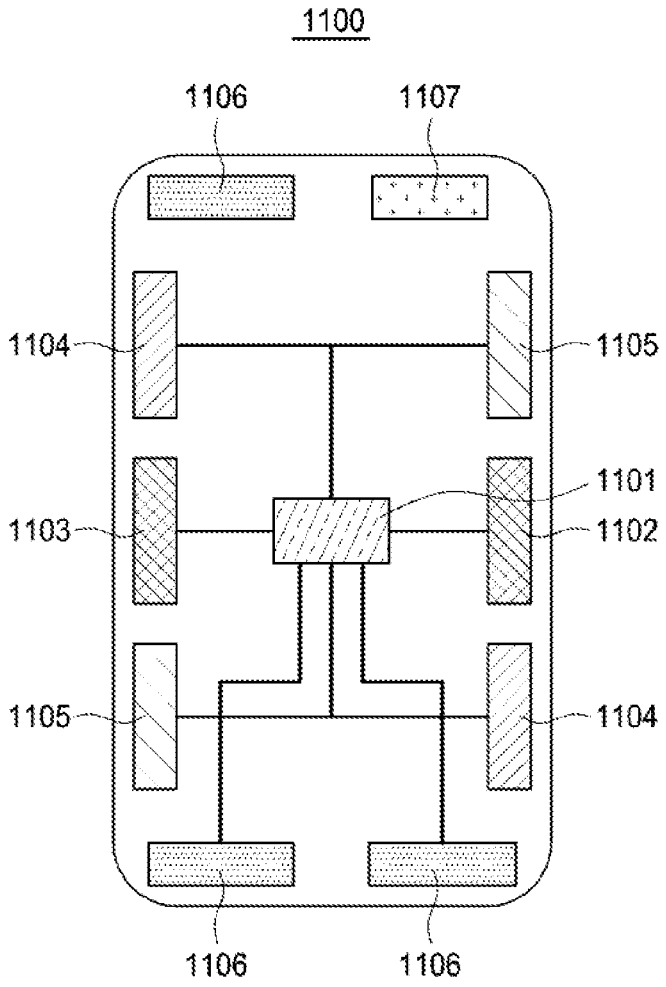
FIG. 2 is a plan diagram illustrating an example of an electronic device.

FIG. 2 is a perspective diagram illustrating an example of an electronic device.

Referring to FIG. 2, an electronic device may be a smartphone 1100, for example. In the smartphone 1100, a modem 1101, and various types of antenna modules 1102, 1103, 1104, 1105, and 1106 connected to the modem 1101 through a rigid printed circuit board, a flexible printed circuit board, and/or a rigid flexible printed circuit board may be disposed. If desired, a Wi-Fi module 1107 may also be disposed. The antenna modules 1102, 1103, 1104, 1105, and 1106 may include the antenna modules 1102, 1103, 1104, and 1105 for various frequency ranges for 5G mobile communications, such as the antenna module 1102 for a 3.5 GHz band frequency, the antenna module 1103 for a 5 GHz band frequency, the antenna module 1104 for a 28 GHz band frequency, the antenna module 1105 for a 39 GHz band frequency, and the like, and may further include the other antenna module 1106 for 4G communications, but an example embodiment thereof is not limited thereto. The electronic device is not limited to the smartphone 1100, and may be implemented by the other electronic devices described above.

Figure 3:
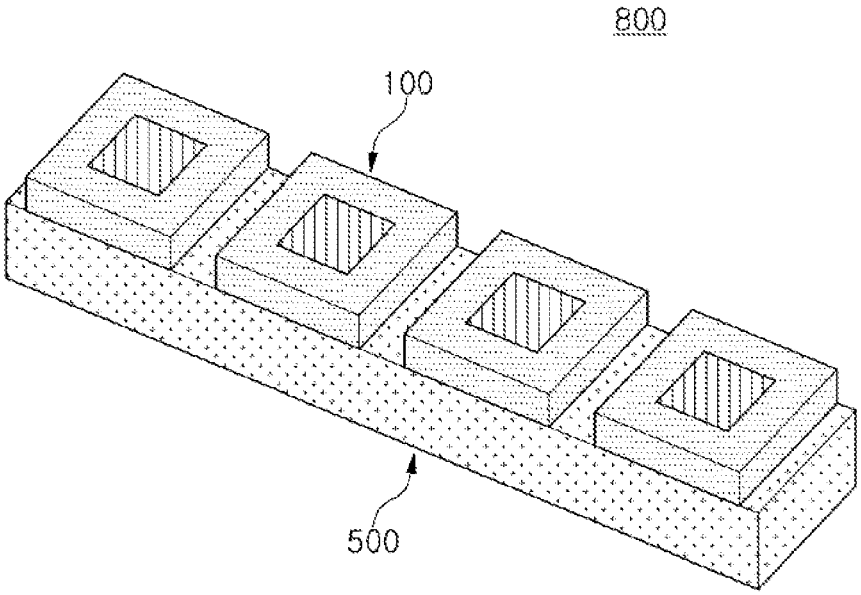
FIG. 3 is a perspective diagram illustrating an example of an antenna module.

FIG. 3 is a perspective diagram illustrating an example of an antenna module.

Referring to the diagram, an antenna module 800 in the example embodiment may include an antenna substrate 500 and a plurality of antennas 100 mounted on an upper surface of the antenna substrate 500. Each of the antennas 100 may be configured as a chip-type patch antenna. A chip in a chip-type antenna may indicate that the antenna 100 may be separately manufactured with respect to the antenna substrate 500 providing a dispositional space of the antenna 100 and may be disposed in the substrate. Each of the antennas 100 may be surface-mounted on the antenna substrate 500 using a connector metal such as solder, or the like. The antennas 100 may be disposed in a 1×4 arrangement as illustrated in FIG. 3, but an example embodiment thereof is not limited thereto. If desired, the antennas 100 may be disposed in various forms such as in a 1×2 or 2×2 arrangement. If desired, an electronic component may be mounted on a lower surface of the antenna substrate 500. The electronic component may include a radio frequency integrated circuit (RFIC), a power management IC (PMIC), or the like. The electronic component may further include a chip-type passive component, such as a chip-type capacitor or a chip-type inductor, for example. The electronic component may be surface-mounted on the antenna substrate 500 using a connector metal such as solder, or the like.

The antenna substrate 500 may be configured as a multilayer printed circuit board (PCB) including a plurality of insulating layers, a plurality of wiring layers, and a plurality of via layers. The antenna substrate 500 may include a first region including a plurality of first insulating layers, a plurality of first wiring layers, and a plurality of first via layers, and a second region including a plurality of second insulating layers, a plurality of second wiring layers, and a plurality of second via layers. In a thickness direction, the first region may be disposed on an upper side of the antenna substrate 500, and the second region may be disposed on a lower side of the antenna substrate 500. The first region may function as an antenna member, and the second region may function as a redistribution member. For example, at least a portion of the plurality of first insulating layers may include a material having a dielectric dissipation factor (Df) lower than that of at least a portion of the plurality of second insulating layers.

The plurality of first insulating layers may include a laminate in which a thermoplastic resin layer and a thermosetting resin layer are alternately layered. The thermoplastic resin layer may include a material effective for transmission of a radio frequency signal, and the thermosetting resin layer may include a material advantageous to transmission of a radio frequency signal and having adhesiveness. By using the multilayer resin layers, an insulation body which may be advantageous to transmission of a radio frequency signal and may have improved adhesiveness may be provided. The plurality of first wiring layers may be disposed on the thermoplastic resin layers, respectively, and may be embedded in the thermosetting resin layers, and may be connected to each other through the plurality of first via layers. Each of the plurality of first via layers may simultaneously penetrate an adjacent thermoplastic resin layer and an adjacent thermosetting resin layer.

As the thermoplastic resin layer, a liquid crystal polymer (LCP), polytetrafluoroethylene (PTFE), polyphenylene sulfide (PPS), polyphenylene ether (PPE), polyimide (PI), or the like, may be used in terms of transmission of a radio frequency signal. A dielectric dissipation factor (Df) may be adjusted according to a type of resin, a type of filler included in the resin, a content of filler, and the like, of the thermoplastic resin layer. A dielectric dissipation factor (Df) may be a value related to dielectric dissipation, and dielectric dissipation may refer to loss of power generated when an alternative electric field is formed on a resin layer (a dielectric material). A dielectric dissipation factor (Df) may be proportional to dielectric dissipation, and the lower the dielectric dissipation factor (Df), the less the dielectric dissipation. The thermoplastic resin layer having low dielectric dissipation properties may be advantageous for reduction of the dissipation in terms of transmission of a radio frequency signal. The dielectric dissipation factor (Df) of the thermoplastic resin layer may be 0.003 or lower, and may be, for example, 0.002 or lower. Also, a dielectric constant (Dk) of the thermoplastic resin layer may be 3.5 or lower.

As the thermosetting resin layer, polyphenylene ether (PPE), modified polyimide (PI), modified epoxy, or the like, may be used in terms of transmission of a radio frequency signal. A dielectric dissipation factor (Df) may be adjusted according to a type of resin, a type of filler included in the resin, a content of filler, and the like, of the thermosetting resin layer. The thermosetting resin layer having low dielectric dissipation properties may be advantageous for reduction of the dissipation in terms of transmission of a radio frequency signal. A dielectric dissipation factor (Df) of the thermosetting resin layer may be 0.003 or lower, and may be, for example, 0.002 or lower. Also, a dielectric constant (Dk) of the thermosetting resin layer may be 3.5 or lower.

A thickness of the thermoplastic resin layer may be greater than a thickness of the thermosetting resin layer. It may be desirable to have the above-described thickness relationship in terms of transmission of a radio frequency signal. An interfacial surface between the thermoplastic resin layer and the thermosetting resin layer, upwardly and downwardly adjacent to each other, may include a rough surface. A rough surface may refer to a surface having serrations by being roughened. By including the rough surface, the thermoplastic resin layer and the thermosetting resin layer, upwardly and downwardly adjacent to each other, may secure adhesiveness working towards each other.

In one example, a thickness of an element may means a dimension of the element in a thickness direction of the element, and may be one of an average thickness, a maximum thickness, and a thickness measured in a center portion of the element. The thickness direction of the element may refer to a direction in which major surfaces of the element oppose each other. In another example, the thickness direction of the element may refer to a direction in which the element, as well as other elements, are laminated.

In one example, the thickness of the element may be determined by defining a predetermined number (e.g., 5) of points to the left and the predetermined number (e.g., 5) of points to the right from a reference center point of the element at equal intervals (or non-equal intervals, alternatively), measuring a thickness of each of the points at equal intervals (or non-equal intervals, alternatively), and obtaining an average value therefrom, based on an image of a cross-section cut, scanned by, for example, a scanning electron microscope (SEM). The reference center point may have the same distance, or substantially the same distance in consideration of a measurement error, from opposing edges of the element in the cross-section cut. In this case, the thickness may be an average thickness of the element.

Alternatively, the thickness may be determined by defining a predetermined number (e.g., 5) of points to the left and the predetermined number (e.g., 5) of points to the right from a reference center point of the element at equal intervals (or non-equal intervals, alternatively), measuring a thickness of each of the points at equal intervals (or non-equal intervals, alternatively), and obtaining a maximum value therefrom, based on an image of a cross-section cut, scanned by, for example, a scanning electron microscope (SEM). In this case, the thickness may be a maximum thickness of the element.

Alternatively, the thickness may be a thickness of a reference center point of the element, based on an image of a cross-section cut scanned by, for example, a scanning electron microscope (SEM). The reference center point may have the same distance, or substantially the same distance in consideration of a measurement error, from opposing edges of the element in the cross-section cut.

The plurality of second insulating layers may include an insulating material. As the insulating material, a thermosetting resin such as an epoxy resin, a thermoplastic resin such as a polyimide resin, a material including a reinforcing material including woven glass fiber and/or inorganic filler along with the above-described resins, such as such as prepreg, ajinomoto build-up film (ABF), photoimageable dielectric (PID), or the like, may be used.

The plurality of first and second wiring layers may include a metal material. As the metal material, copper (Cu), aluminum (Al), silver (Ag), tin (Sn), gold (Au), nickel (Ni), lead (Pb), titanium (Ti), or alloys thereof may be used. The plurality of first and second wiring layers may be formed by an additive process (AP), a semi AP (SAP), a modified SAP (MSAP), a tenting (TT), or the like, and accordingly, each of the plurality of first and second wiring layers may include a seed layer, an electroless plating layer, and an electrolytic plating layer formed based on the seed layer. Each of the plurality of first and second wiring layers may perform various functions according to a design of the respective layer. For example, each of the plurality of first and second wiring layers may include a feeding pattern, and may also include a ground pattern, a power pattern, a signal pattern, or the like. Each pattern may include a line pattern, a plane pattern, and/or a pad pattern.

The plurality of first and second via layers may include a metal material. As the metal material, copper (Cu), aluminum (Al), silver (Ag), tin (Sn), gold (Au), nickel (Ni), lead (Pb), titanium (Ti), or alloys thereof may be used. The plurality of first and second via layers may be formed by a plating process such as an AP, an SAP, an MSAP, a TT, or the like, and accordingly, each of the plurality of first and second via layers may include a seed layer, an electroless plating layer, and an electrolytic plating layer formed based on the seed layer. The plurality of first and second via layers may perform various functions according to a design of the respective layer. For example, each of the plurality of first and second via layers may include a feeding via for feeding pattern connection, a signal via for signal connection, a ground via for ground connection, a power via for power connection, and the like. Each via may be completely filled with a metal material, or a metal material may be formed along a wall of a via hole, and may have various shapes such as a tapered shape, or the like.

Figure 4:
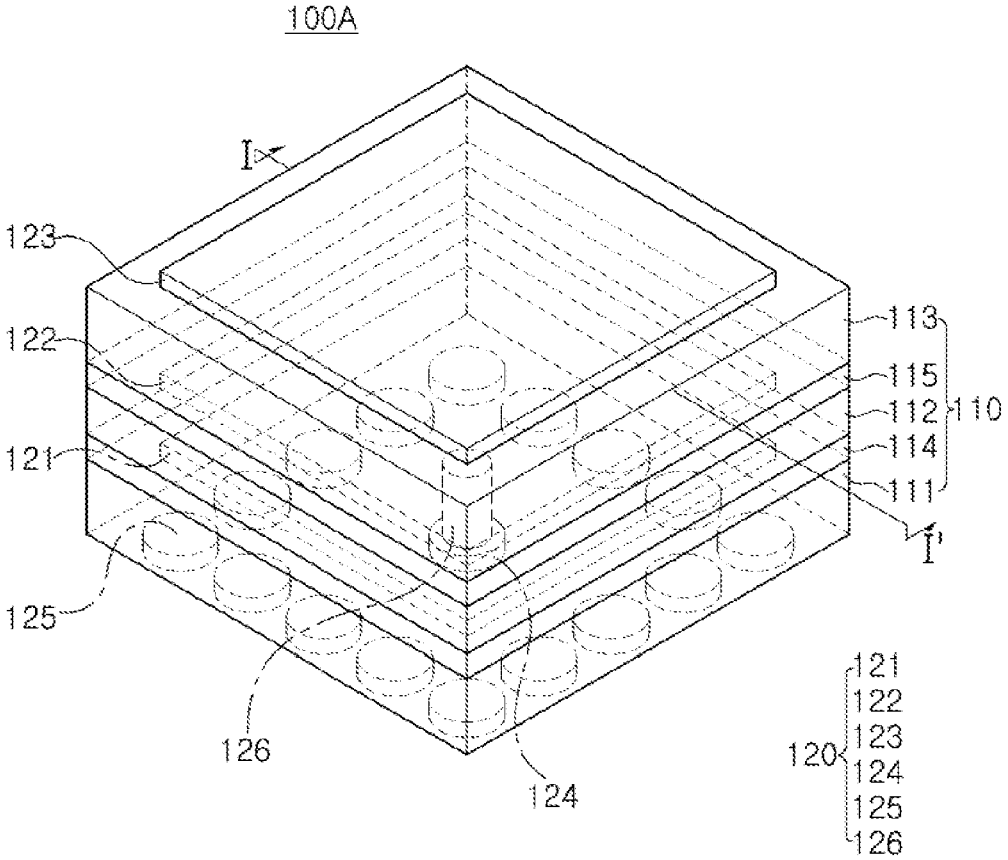
FIG. 4 is a perspective diagram illustrating an example of an antenna.

FIG. 4 is a perspective diagram illustrating an example of an antenna.

Figure 5:
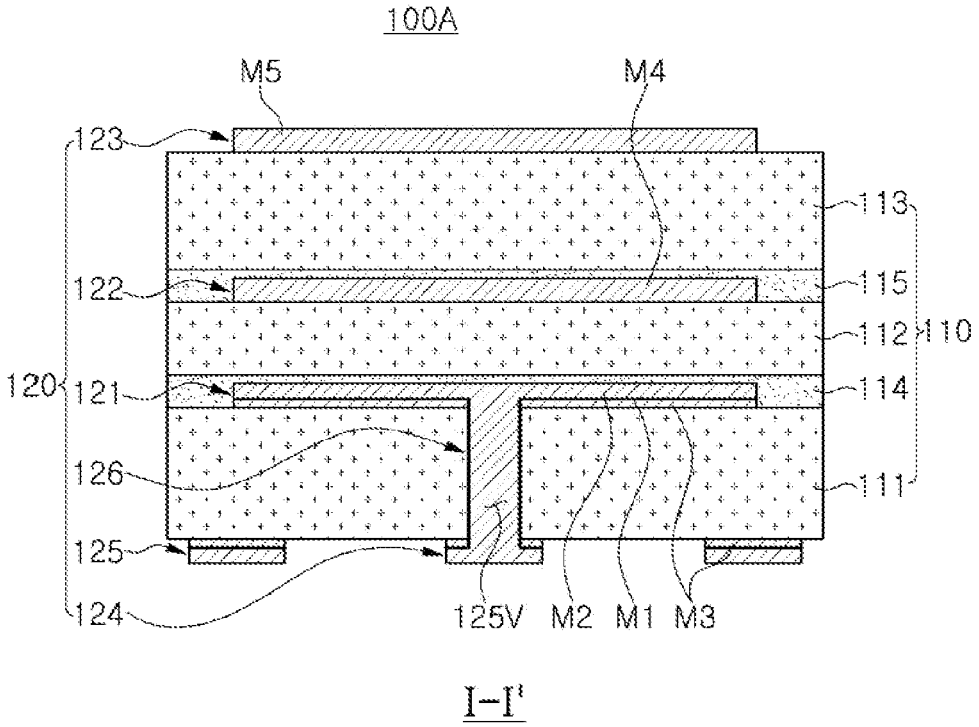
FIG. 5 is a cross-sectional diagram illustrating the antenna illustrated in FIG. 4 along line I-I'.

FIG. 5 is a cross-sectional diagram illustrating the antenna illustrated in FIG. 4 along line I-I'.

Referring to the diagrams, an antenna 100A in the example embodiment may include a body portion 110 and a pattern portion 120. The body portion 110 may include a first dielectric layer 111, a second dielectric layer 112, a third dielectric layer 113, a first adhesive layer 114 disposed between the first and second dielectric layers 111 and 112 and connecting the first and second dielectric layers 111 and 112 to each other, and a second adhesive layer 115 disposed between the second and third dielectric layers 112 and 113 and connecting the second and third dielectric layers 112 and 113 to each other. The pattern portion 120 may include a patch pattern 121 disposed on an upper surface of the first dielectric layer 111 and embedded in the first adhesive layer 114, a first coupling pattern 122 disposed on an upper surface of the second dielectric layer 112 and embedded in the second adhesive layer 115, and a second coupling pattern 123 disposed on an upper surface of the third dielectric layer 113. The patch pattern 121, the first coupling pattern 122, and the second coupling pattern 123 may at least partially overlap one another on a plane. In one example, a first portion overlapping a second portion on a plane may mean that, on the plane which is perpendicular to a direction in which the first portion is stacked on or below the second portion, or substantially perpendicular to the direction in which the first portion is stacked on or below the second portion in consideration of a measurement error or a process error, the first portion and the second portion overlay with each other. If desired, the pattern portion 120 may further include at least one of a first pad pattern 124 disposed on a lower surface of the first dielectric layer 111, a plurality of second pad patterns 125 disposed on a lower surface of the first dielectric layer 111 and surrounding the first pad pattern 124 on a plane, and a through-via 126 penetrating the first dielectric layer 111 and connecting the patch pattern 121 to the first pad pattern 124.

As described above, as a technique of communications of portable terminal devices has been developed from 4G to 5G, a band used for communications has been designed to be wire-range and multi-band. As mmWave is used, a physical size of a receiver should be decreased, and an antenna used in a portable terminal device should have increased efficiency to implement a wideband and should have a reduced size at the same time. In accordance with the trend, an antenna which is generally manufactured as a printed circuit board (PCB) having a multilayer structure may be manufactured as a chip-type antenna using a high-k material to reduce a size thereof, and a rigid-flexible PCB may be employed to increase efficiency such that radiation properties may increase.

When a chip patch antenna is implemented, at least two coupling patterns which may overlap a patch pattern upwardly and downwardly and may be coupled to the patch pattern may be necessary to cover a radio frequency band. Such a chip-package antenna may be implemented through a matching process in which a patch pattern and a pad pattern are formed on an upper surface and a lower surface of the first dielectric layer, respectively, a coupling pattern is formed on an upper surface and a lower surface of the second dielectric layer, respectively, and the first and second dielectric layers may be adhered to each other using an adhesive layer. However, a matching tolerance may occur in the matching process, and thus, there may be a difficulty in performing a large-area process. Also, it may be difficult to use an organic base material. In the case in which an organic base material is not used, as a high-k material, a material of a dielectric layer, an inorganic material such as ceramic may be considered. When ceramic is implemented or handled as a thin film, however, ceramic may easily be broken, and ceramic has poor workability such that it may be difficult to form a via for conduction between layers.

Differently from the above-described example, the antenna 100A in the example embodiment may be configured as a chip-type patch antenna including the body portion 110 and the pattern portion 120 formed in the body portion 110, and may have a structure in which the first dielectric layer 111, the first adhesive layer 114, the second dielectric layer 112, the second adhesive layer 115, and the third dielectric layer 113 included in the body portion 110, and the patch pattern 121, the first coupling pattern 122, and the second coupling pattern 123 included in the pattern portion 120 may be sequentially layered. The structure may be implemented by a layering process, for example, in which the patch pattern 121 and the pad patterns 124 and 125 may be formed on an upper surface and a lower surface of the first dielectric layer 111, respectively, the first adhesive layer 114 may be layered on an upper surface of the first dielectric layer 111, the second dielectric layer 112 on an upper surface of which the first coupling pattern 122 is formed may be layered on the first adhesive layer 114, the second adhesive layer 115 may be layered on an upper surface of the second dielectric layer 112, and the third dielectric layer 113 on an upper surface of which the second coupling pattern 123 is formed may be layer on the second adhesive layer 115. The layering process may improve matching properties among the patterns 121, 122, 123, 124, and 125 formed on the layers in relation to the above-described matching process, and as a result, performance of the antenna 100A may improve.

The first to third dielectric layers 111, 112, and 113 included in the body portion 110 may include an organic binder and an inorganic filler. As the organic binder, various types of polymers such as PTFE, epoxy, and the like, may be used, and desirably, PTFE may be used. As the inorganic filler, various types of ceramic fillers such as silicon dioxide ($SiO_2$), titanium dioxide ($TiO_2$), aluminum oxide ($Al_2O_3$), or the like, may be used. The ceramic filler may have various shapes such as an angular shape, a circular shape, or the like, and may have various sizes, having a diameter of 50 μm or less. For example, each of the first to third dielectric layers 111, 112, and 113 may include a ceramic-polymer composite. Such a composite may have high-k properties, and may secure a significant level of handleability and workability. For example, a large area process may be available as handleability improves. Also, as processability improves, a via process using a computer numerical control (CNC) drill or laser may easily be performed. Accordingly, a design rule may improve such that implementation of a fine circuit through a plating process, for example, may be available, and a via hole 125V having a reduced diameter may be applied. Thus, advantages of a chip-type patch antenna may be obtained, and various issues according to a defect in handleability and processability may be addressed. If desired, each of the first to third dielectric layers 111, 112, and 113 may further include a reinforcing material. As a reinforcing material, woven glass fiber, for example, may be used. For example, the first to third dielectric layers 111, 112, and 113 may include a ceramic-polymer composite impregnated in woven glass fiber. The composite including woven glass fiber as above may have improved strength. Accordingly, improved handleability and processability may be secured.

A dielectric constant (Dk) of each of the first and third dielectric layers 111 and 113 may be greater than that of the second dielectric layer 112. For example, the first dielectric layer 111 disposed on a lowermost side of the body portion 110 and providing a dielectric region between the patch pattern 121 and the pad patterns 124 and 125 and the third dielectric layer 113 disposed on an uppermost side of the body portion 110 and providing a dielectric region between the first and second coupling patterns 122 and 123 may have a dielectric constant Dk greater than that of the second dielectric layer 112 providing a dielectric region between the patch pattern 121 and the first coupling pattern 122. When the above-described dielectric constant Dk relationship is satisfied, properties of the antenna 100A may improve. Similarly, a dielectric constant Dk of each of the first and third dielectric layers 111 and 113 may be greater than the dielectric constant Dk of the first adhesive layer 114. Also, the second adhesive layer 115 may have a dielectric constant Dk greater than that of the first adhesive layer 114. In this case, sufficient adhesiveness may be obtained by the first and second adhesive layers 114 and 115, and the first and third dielectric layers 111 and 113 may provide a substantially high dielectric constant Dk to the body portion 110 such that antenna properties may improve. Also, by including a layer having a low dielectric constant Dk in a portion which is less important for reduction of a size, an overall effective dielectric constant Dk of the antenna 100A may decrease such that radiation efficiency may improve. For example, an RF signal by the patch pattern 121 and the first and second coupling patterns 122 and 123 may easily be radiated in a thickness direction (a z-direction). Also, in some cases, a relatively adverse effect caused by the first and second adhesive layers 114 and 115 between the patch pattern 121 and the first and second coupling patterns 122 and 123 in relation to implementation of antenna properties may be significantly reduced. The dielectric constant (Dk) may be, although not limited thereto, measured through a vector network analyzer using a dielectric assessment kit (DAK), for example.

Each of the patch pattern 121, the first coupling pattern 122, the second coupling pattern 123, the first pad pattern 124, the plurality of second pad patterns 125, and the through-via 126 may be formed through a plating process. As the first to third dielectric layers 111, 112, and 113 included in the body portion 110 may have improved handleability and processability, the pattern portion 120 may easily be formed through a plating process. Accordingly, a design rule may improve such that a fine circuit may easily be implemented, for example. The patch pattern 121 may include a greater number of metal layers, greater than the number of metal layers included in the first and second coupling patterns 122 and 123. For example, each of the patch pattern 121, the first pad pattern 124, and the plurality of second pad patterns 125, formed on the first dielectric layer 111 in which the through-via 126 is formed, may be formed by a TT or an MSAP, and in this case, each of the elements may include a first metal layer M1, a seed layer formed by an electroless plating process, a second metal layer M2, a plating layer formed by an electrolytic plating process, and a third metal layer M3, a metal foil, or the like. The first and second coupling patterns 122 and 123 formed on the second and third dielectric layers 112 and 113 in which the through-via 126 is not formed may be formed by a TT process, and in this case, each of the first and second coupling patterns 122 and 123 may only include fourth and fifth metal layers M4 and M5, metal foils.

The through-via 126 may be a filled-type via. For example, the through-via 126 may be formed by a TT or an MSAP while the patch pattern 121, the first pad pattern 124, and the plurality of second pad patterns 125 are formed. In this case, the through-via 126 may include a first metal layer M1 disposed on a wall of a via hole 125V formed in the first dielectric layer 111, and a second metal layer M2 disposed on the first metal layer M1. The second metal layer M2 may fill the via hole 125V with the first metal layer M1 disposed between the wall of the via hole 125V and the second metal layer M2. As the first dielectric layer 111 has improved workability as described above, the filled-type through-via 126 may easily be formed.

In the description below, the elements of the antenna 100A of the example embodiment will be described in greater detail with reference to the drawings.

Each of the first and third dielectric layers 111 and 113 may include a material having a high dielectric constant (Dk). For example, each of the first and third dielectric layers 111 and 113 may include an organic binder and an inorganic filler as described above. As the organic binder, various types of polymers such as PTFE, epoxy, and the like, may be used, and desirably, PTFE may be used. As the inorganic filler, various types of ceramic fillers such as silicon dioxide ($SiO_2$), titanium dioxide ($TiO_2$), aluminum oxide ($Al_2O_3$), or the like, may be used. The ceramic filler may have various shapes such as an angular shape, a circular shape, or the like, and may have various sizes, having a diameter of 50 μm or less. For example, each of the first and third dielectric layers 111 and 113 may include a ceramic-polymer composite. Each of the first and second dielectric layers 111 and 112 may further include a reinforcing material as described above. As the supplementary material, woven glass fiber may be used, for example. For example, each of the first and third dielectric layers 111 and 113 may include a ceramic-polymer composite impregnated in woven glass fiber. A dielectric constant (Dk) of each of the first and third dielectric layers 111 and 113 may be 6 or greater, and dielectric constants (Dk) of the first and third dielectric layers 111 and 113 may be the same or may be different.

The second dielectric layer 112 may include a material having a relatively low dielectric constant Dk, lower than those of first and third dielectric layers 111 and 113. For example, the second dielectric layer 112 may include an organic binder and an inorganic filler as described above, and may have a relatively low dielectric constant Dk by adjusting a content of the inorganic filler. As the organic binder, various types of polymers such as PTFE, epoxy, and the like, may be used, and desirably, PTFE may be used. As the inorganic filler, various types of ceramic fillers such as silicon dioxide ($SiO_2$), titanium dioxide ($TiO_2$), aluminum oxide ($Al_2O_3$), or the like, may be used. The ceramic filler may have various shapes such as an angular shape, a circular shape, or the like, and may have various sizes, having a diameter of 50 μm or less. For example, the second dielectric layer 112 may also include a ceramic-polymer composite. The second dielectric layer 112 may also further include a reinforcing material as described above. As the reinforcing material, woven glass fiber may be used, for example. For example, the second dielectric layer 112 may also include a ceramic-polymer composite impregnated in woven glass fiber. To implement improved antenna properties, the second dielectric layer 112 may have a thickness less than those of the first and third dielectric layers 111 and 113.

The first adhesive layer 114 may include a material having a dielectric constant (Dk) lower than those of the first and third dielectric layers 111 and 113, and having adhesive force stronger than that of the first and second dielectric layers 111 and 112. For example, the first adhesive layer 114 may include polymer having a dielectric constant (Dk) lower than those of the first and third dielectric layers 111 and 113 and having stronger adhesive force than that of the first and second dielectric layers 111 and 112. As the polymer, LCP, PI, PTFE, epoxy, or the like, may be used, but an example embodiment thereof is not limited thereto. To implement improved antenna properties, a thickness of the first adhesive layer 114 may be less than a thickness of each of the first to third dielectric layers 111, 112, and 113.

The second adhesive layer 115 may include a material having a dielectric constant (Dk) greater than that of the first adhesive layer 114, and having adhesive force stronger than that of the second and third dielectric layers 112 and 113. For example, the second adhesive layer 115 may include polymer having a dielectric constant (Dk) greater than that of the first adhesive layer 114 and having stronger adhesive force than that of the second and third dielectric layers 112 and 113. As the polymer, LCP, PI, PTFE, epoxy, or the like, may be used, but an example embodiment thereof is not limited thereto. To implement improved antenna properties, the second adhesive layer 115 may have a thickness less than a thickness of each of the first to third dielectric layers 111, 112, and 113.

The patch pattern 121 may include a metal material. As the metal material, copper (Cu), aluminum (Al), silver (Ag), tin (Sn), gold (Au), nickel (Ni), lead (Pb), titanium (Ti), or alloys thereof may be used. The patch pattern 121 may be formed by a plating process such as a TT or an MSAP, and accordingly, the patch pattern 121 may include a first metal layer M1, a seed layer formed by an electroless plating process, a second metal layer M2, a plating layer formed by an electrolytic plating process, and a third metal layer M3, a metal foil, or the like. The first metal layer M1 may be disposed on an upper surface of the first dielectric layer 111. The second metal layer M2 may be disposed on the first metal layer M1, and may have a thickness greater than a thickness of the first metal layer M1. The third metal layer M3 may be disposed on an upper surface of the first dielectric layer 111 before a seed layer is formed, and may thus be disposed between the upper surface of the first dielectric layer 111 and the first metal layer M1. The third metal layer M3 may have a thickness greater than a thickness of the first metal layer M1 and less than a thickness of the second metal layer M2.

The patch pattern 121 may receive an RF signal through a feeding pattern and a feeding via in an antenna substrate and may transmit the RF signal in a thickness direction (a z-direction) when the antenna 100A is mounted on an antenna substrate, and may transfer the RF signal received in the thickness direction to an electronic component mounted on the antenna substrate, such as an RFIC, for example, through the feeding pattern and the feeding via disposed in the antenna substrate. The patch pattern 121 may have an intrinsic resonant frequency according to intrinsic elements such as a shape, a size, a height, and dielectric constants of the dielectric layers 111 and 112, such as 28 GHz, 39 GHz, or the like, for example. For example, the patch pattern 121 may be electrically connected to an electronic component, such as an RFIC, through the feeding pattern and the feeding via disposed in the antenna substrate, such that the patch pattern 121 may transmit and receive a horizontal pole (H pole) RF signal and a vertical pole (V pole) RF signal, which are polarized to each other.

The first coupling pattern 122 may include a metal material. As a metal material, copper (Cu), aluminum (Al), silver (Ag), tin (Sn), gold (Au), nickel (Ni), lead (Pb), titanium (Ti), or alloys thereof may be used. The first coupling pattern 122 may be formed by a plating process such as a TT, or the like, and accordingly, the first coupling pattern 122 may only include a fourth metal layer M4, a metal foil, or the like. The fourth metal layer M4 may be disposed on an upper surface of the second dielectric layer 112. The fourth metal layer M4 may include a single metal element, such as rolled copper or electrolytic copper, for example.

The first coupling pattern 122 may be disposed on an upper side of the patch pattern 121, and may be disposed in a thickness direction, for example. The first coupling pattern 122 may be disposed to at least partially overlap the patch pattern 121 on a plane. By electromagnetic coupling between the first coupling pattern 122 and the patch pattern 121, an additional resonant frequency approximate to an intrinsic resonant frequency described above may be obtained, and accordingly, a wide bandwidth may be implemented.

The second coupling pattern 123 may include a metal material. As a metal material, copper (Cu), aluminum (Al), silver (Ag), tin (Sn), gold (Au), nickel (Ni), lead (Pb), titanium (Ti), or alloys thereof may be used. The second coupling pattern 123 may be formed by a plating process such as a TT, or the like, and accordingly, the second coupling pattern 123 may only include a fifth metal layer M5, a metal foil, or the like. The fifth metal layer M5 may be disposed on an upper surface of the third dielectric layer 113. The fifth metal layer M5 may include a single metal element, such as rolled copper or electrolytic copper, for example.

The second coupling pattern 123 may be disposed on an upper side of the patch pattern 121, and may be disposed in a thickness direction, for example. The second coupling pattern 123 may be disposed to at least partially overlap the first coupling pattern 122 on a plane. By electromagnetic coupling between the first and second coupling patterns 122 and 123, a radio frequency bandwidth may easily be covered.

The pad patterns 124 and 125 may include a metal material. As the metal material, copper (Cu), aluminum (Al), silver (Ag), tin (Sn), gold (Au), nickel (Ni), lead (Pb), titanium (Ti), or alloys thereof may be used. The pad patterns 124 and 125 may be formed by a plating process such as a TT, an MSAP, or the like, and accordingly, the pad patterns 124 and 125 may include a first metal layer M1, a seed layer formed by an electroless plating process, a second metal layer M2, a plating layer formed by an electrolytic plating process, and a third metal layer M3, a metal foil, or the like. The first metal layer M1 may be disposed on a lower surface of the first dielectric layer 111. The second metal layer M2 may be disposed on the first metal layer M1, and may have a thickness greater than a thickness of the first metal layer M1. The third metal layer M3 may be disposed on the lower surface of the first dielectric layer 111 before the seed layer is formed, and the third metal layer M3 may thus be disposed between the lower surface of the first dielectric layer 111 and the first metal layer M1. The third metal layer M3 may have a thickness greater than a thickness of the first metal layer M1 and less than a thickness of the second metal layer M2.

The pad patterns 124 and 125 may connect the antenna 100A to an antenna substrate, or the like. For example, an upper surface of the first pad pattern 124 may be connected to the patch pattern 121 through the through-via 126 penetrating the first dielectric layer 111, and a lower surface of the first pad pattern 124 may be connected to a feeding pattern of an antenna substrate through a connector metal, a feeding via, or the like. Also, the plurality of second pad patterns 125 may be disposed to surround the first pad pattern 124 on a plane, and a lower surface of each of the plurality of second pad patterns 125 may be connected to a ground pattern of an antenna substrate through a connector metal, a connection via, or the like.

The through-via 126 may include a metal material. As the metal material, copper (Cu), aluminum (Al), silver (Ag), tin (Sn), gold (Au), nickel (Ni), lead (Pb), titanium (Ti), or alloys thereof may be used. The through-via 126 may be formed by a plating process such as an MASP, a TT, or the like, and accordingly, the through-via 126 may include a first metal layer M1 disposed on a wall of a via hole 125V formed in the first dielectric layer 111, and a second metal layer M2 disposed on the first metal layer M1. The second metal layer M2 may fill the via hole 125V with the first metal layer M1 disposed between the wall of the via hole 125V and the second metal layer M2. The through-via 126 may function as a feeding via in the antenna 100A.

Figure 6:
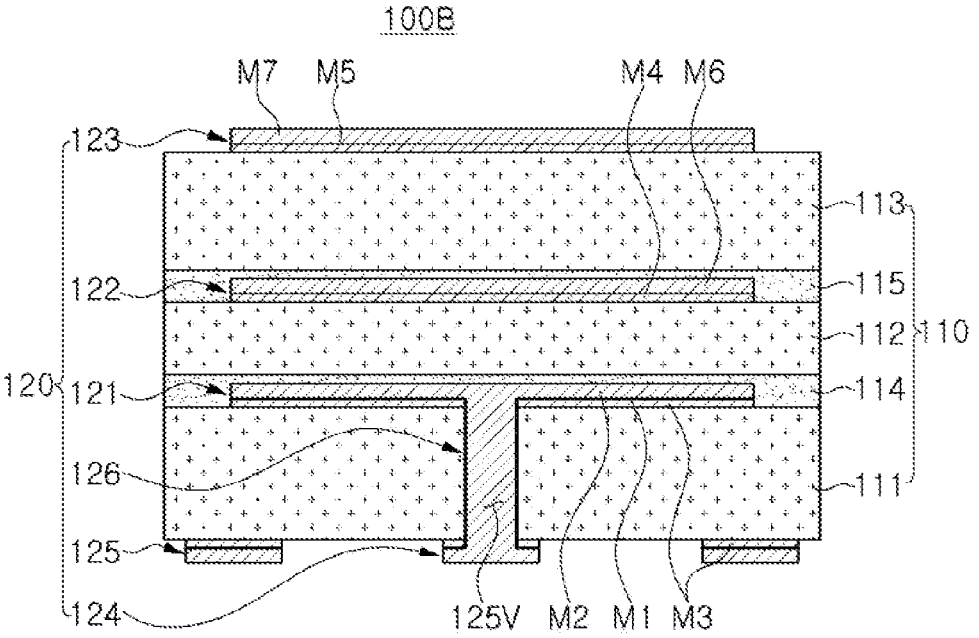
FIG. 6 is a cross-sectional diagram illustrating a modified example of the antenna illustrated in FIG. 5.

FIG. 6 is a cross-sectional diagram illustrating a modified example of the antenna illustrated in FIG. 5.

Referring to the diagram, in an antenna 100B in the modified example, the first and second coupling patterns 122 and 123 may be formed through an MSAP process, differently from the antenna 100A described in the aforementioned example embodiment. Accordingly, the first coupling pattern 122 may include a fourth metal layer M4, a metal foil, or the like, disposed on an upper surface of a second dielectric layer 112, and may further include a sixth metal layer M6 disposed on the fourth metal layer M4. The sixth metal layer M6 may be formed by an electrolytic plating process, and may have a thickness greater than that of the fourth metal layer M4. Also, the second coupling pattern 123 may include a fifth metal layer M5, a metal foil, or the like, disposed on an upper surface of the third dielectric layer 113, and may further include a seventh metal layer M7 disposed on the fifth metal layer M5. The seventh metal layer M7 may be formed by an electrolytic process, and may have a thickness greater than that of the fifth metal layer M5. The descriptions of the other elements are substantially the same as in the aforementioned example embodiment, and the detailed descriptions thereof will thus not be provided.

Figure 7:
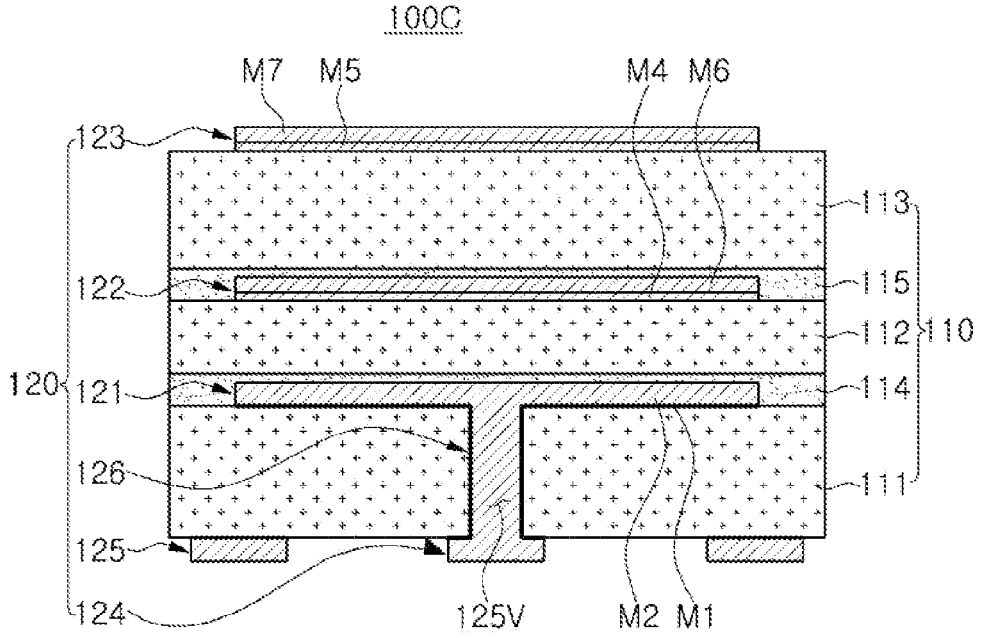
FIG. 7 is a cross-sectional diagram illustrating another modified example of the antenna illustrated in FIG. 5.

FIG. 7 is a cross-sectional diagram illustrating another modified example of the antenna illustrated in FIG. 5.

Referring to the diagram, in an antenna 100C in the modified example, a patch pattern 121 may be formed by a SAP process, differently from the antenna 100A described in the aforementioned example embodiment. Accordingly, the patch pattern 121 may include a first metal layer M1 and a second metal layer M2 and may not include a third metal layer M3. In other words, the patch pattern 121 may be formed by an electroless plating layer and an electrolytic plating layer without a metal foil. Similarly, pad patterns 124 and 125 may include the first metal layer M1 and the second metal layer M2 and may not include a third metal layer M3 described above. Also, first and second coupling patterns 122 and 123 may be formed by an SAP. Accordingly, the first coupling pattern 122 may include a fourth metal layer M4, a seed layer formed on an upper surface of a second dielectric layer 112 by an electroless plating process, not a metal foil, and a sixth metal layer M6 formed on the fourth metal layer M4 by an electrolytic plating process based on the fourth metal layer M4. The sixth metal layer M6 may have a thickness greater than that of the fourth metal layer M4. The second coupling pattern 123 may include a fifth metal layer M5, a seed layer formed on an upper surface of a third dielectric layer 113 by an electroless plating process, not a metal foil, and a seventh metal layer M7 formed on the fifth metal layer M5 by an electrolytic plating process based on the fifth metal layer M5. The seventh metal layer M7 may have a thickness greater than that of the fifth metal layer M5. The descriptions of the other elements are substantially the same as in the aforementioned example embodiment, and the detailed descriptions thereof will thus not be provided.

Figure 8:
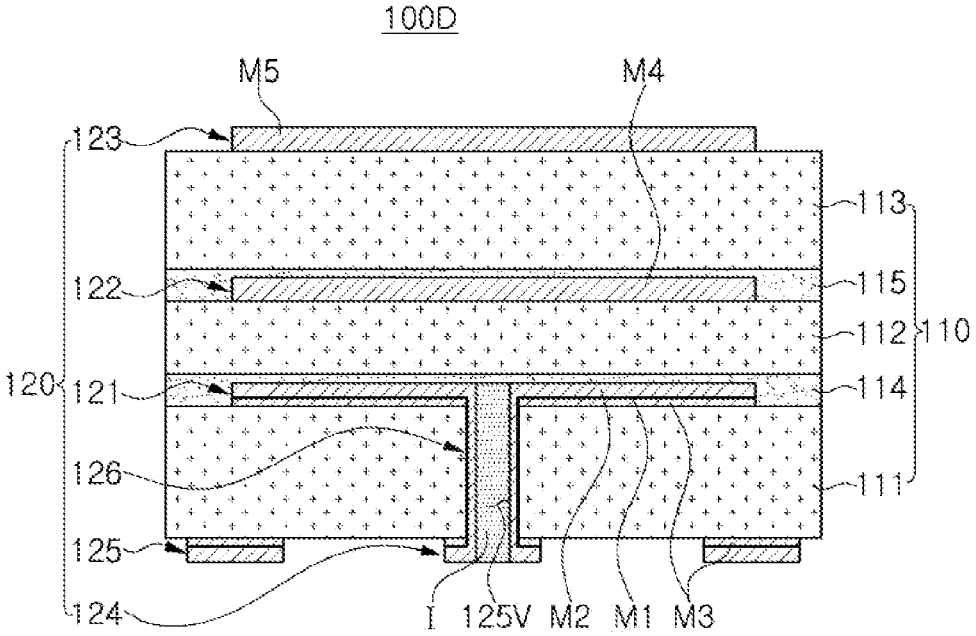
FIG. 8 is a cross-sectional diagram illustrating another example of an antenna.

FIG. 8 is a cross-sectional diagram illustrating another example of an antenna.

Referring to the diagram, in an antenna 100D in another example embodiment, a through-via 126 may include first and second metal layers M1 and M2 as described above, and the second metal layer M2 may be conformally disposed on the first metal layer M1, as compared to the antenna 100A described in the aforementioned example embodiment. In this case, the through-via 126 may further include an ink layer I filling a via hole 125V with the second metal layer M2 disposed between the ink layer I and the first metal layer M1. The ink layer I may be formed by an ink plugging process. As the ink layer I, a thermoplastic or thermosetting insulating material, or a generally used plugging material such as a conductive ink, may be employed. The descriptions of the other elements are substantially the same as in the aforementioned example embodiment, and the detailed descriptions thereof will thus not be provided.

Figure 9:
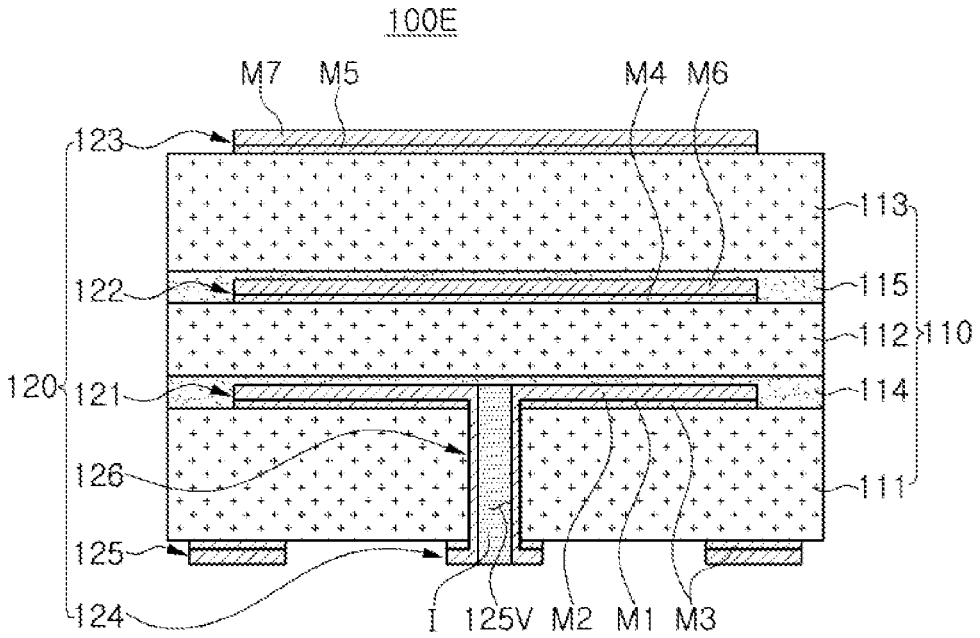
FIG. 9 is a cross-sectional diagram illustrating a modified example of the antenna illustrated in FIG. 8.

FIG. 9 is a cross-sectional diagram illustrating a modified example of the antenna illustrated in FIG. 8.

Referring to the diagram, in an antenna 100E in the modified example, first and second coupling patterns 122 and 123 may be formed by an MSAP process, differently from the antenna 100A described in the aforementioned example embodiment. Accordingly, the first coupling pattern 122 may include a fourth metal layer M4, a metal foil, or the like, disposed on an upper surface of a second dielectric layer 112, and may further include a sixth metal layer M6 disposed on the fourth metal layer M4. The sixth metal layer M6 may be formed by an electrolytic plating process, and may have a thickness greater than that of the fourth metal layer M4. The second coupling pattern 123 may include a fifth metal layer M5, a metal foil, or the like, disposed on an upper surface of the third dielectric layer 113, and may further include a seventh metal layer M7 disposed on the fifth metal layer M5. The seventh metal layer M7 may be formed by an electrolytic plating layer, and may have a thickness greater than that of the fifth metal layer M5. The descriptions of the other elements are substantially the same as in the aforementioned example embodiment, and the detailed descriptions thereof will thus not be provided.

Figure 10:
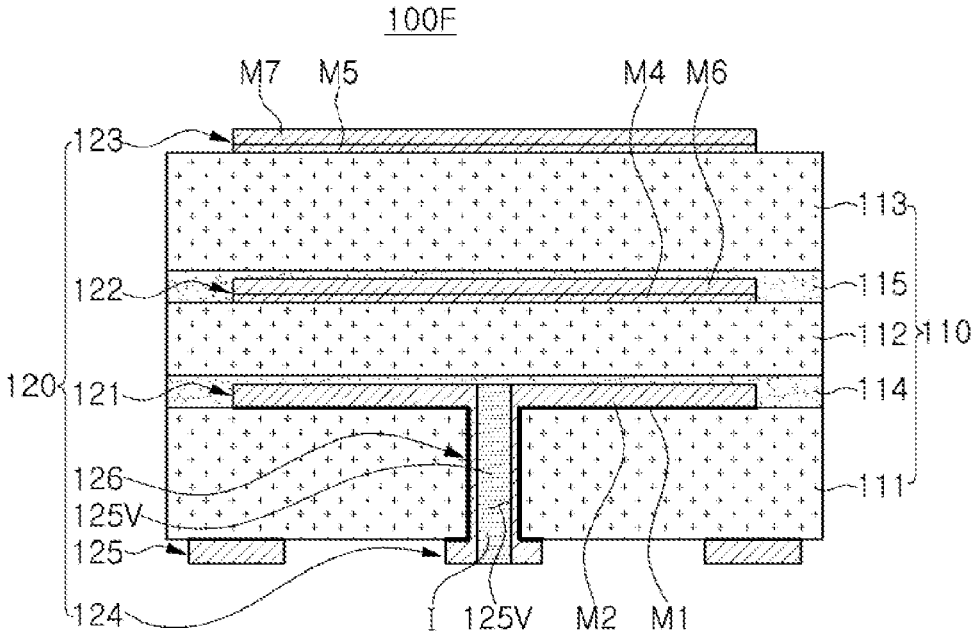
FIG. 10 is a cross-sectional diagram illustrating another modified example of the antenna illustrated in FIG. 8.

FIG. 10 is a cross-sectional diagram illustrating another modified example of the antenna illustrated in FIG. 8.

Referring to the diagram, in an antenna 100F in the modified example, a patch pattern 121 may be formed by a SAP process, differently from the antenna 100A described in the aforementioned example embodiment. Accordingly, the patch pattern 121 may include a first metal layer M1 and a second metal layer M2 and may not include a third metal layer M3 described above. In other words, the patch pattern 121 may be formed by an electroless plating layer and an electrolytic plating layer without a metal foil. Similarly, pad patterns 124 and 125 may include the first metal layer M1 and the second metal layer M2 and may not include a third metal layer M3 described above. Also, first and second coupling patterns 122 and 123 may be formed by an SAP. Accordingly, the first coupling pattern 122 may include a fourth metal layer M4, a seed layer formed on an upper surface of a second dielectric layer 112 by an electroless plating process, not a metal foil, and a sixth metal layer M6 formed on the fourth metal layer M4 by an electrolytic plating process based on the fourth metal layer M4. The sixth metal layer M6 may have a thickness greater than that of the fourth metal layer M4. The second coupling pattern 123 may include a fifth metal layer M5, a seed layer formed on an upper surface of a third dielectric layer 113 by an electroless plating process, not a metal foil, and a seventh metal layer M7 formed on the fifth metal layer M5 by an electrolytic plating process based on the fifth metal layer M5. The seventh metal layer M7 may have a thickness greater than that of the fifth metal layer M5. The descriptions of the other elements are substantially the same as in the aforementioned example embodiment, and the detailed descriptions thereof will thus not be provided.

Figure 11:
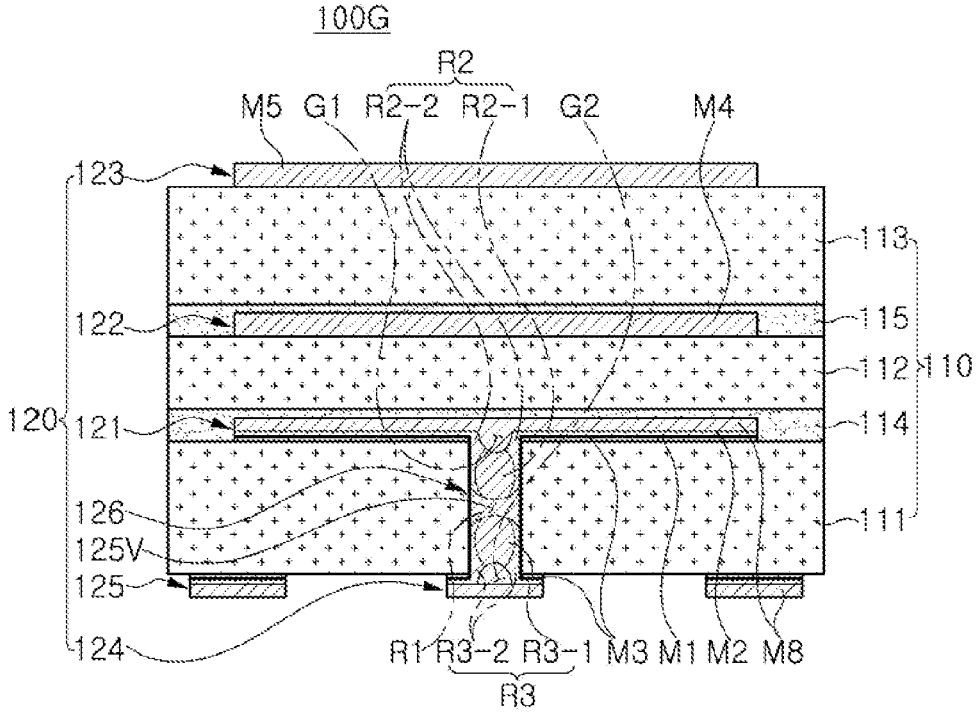
FIG. 11 is a cross-sectional diagram illustrating another example of an antenna.

FIG. 11 is a cross-sectional diagram illustrating another example of an antenna.

Referring to the diagram, in an antenna 100G in another example embodiment, a through-via 126 may include first and second metal layers M1 and M2 as described above, and the second metal layer M2 may include first and second dimples G1 and G2 on an upper surface and a lower surface of the second metal layer M2, respectively. Also, the through-via 126 may further include an eighth metal layer M8 disposed on each of the upper surface and the lower surface of the second metal layer M2. The eighth metal layer M8 of the through-via 126 may fill the first and second dimples G1 and G2. The through-via 126 may include a central region R1 and an upper region R2 and a lower region R3 with the central region R1 interposed therebetween. The upper region R2 and the lower region R3 may include a plurality of regions R2-1 and R2-2 and a plurality of regions R3-1 and R3-2, respectively. An average grain size of a metal in the central region R1 may be less than an average grain size of a metal in the partial region R2-1 of the lower region R2 and the partial region R3-1 of the lower region R3. The through-via 126 configured as above may effectively prevent a void formed in a process of filling a via hole 125V by a plating process. Each of a patch pattern 121, a first pad pattern 124, and a plurality of second pad patterns 125 may include first to third metal layers M1, M2, and M3 may further include an eighth metal layer M8. The eighth metal layer M8 of the patch pattern 121 and the eighth metal layer M8 of the first pad pattern 124 may be connected to the eighth metal layer M8 filling the first and second dimples G1 and G2 of the through-via 126. The eighth metal layer M8 may have a thickness greater than a thickness of each of the first to third metal layers M1, M2, and M3.

The second metal layer M2 may be formed by a pulse periodical reverse (PPR) electrolytic plating process in which a direction of a pulse current is periodically reversible. For example, the second metal layer M2 may be formed on the first metal layer M1 by apply a current by a PPR method. A waveform condition of the PPR may include more than one stages, five or more stages, for example, and current densities and the times in each of the stages may be the same or may be different. It may be desirable to maintain an average value Iavg of current density, closely related to a plating speed, to be 1.5 ASD or lower, in terms of control over a growth speed of plating grains described above. In this case, a growth speed of plating grains may be easily controlled to form the plurality of regions R1, R2, and RG3 having the above-described average grain size, and accordingly, a phenomenon in which the supply of metal ions is insufficient in a process of forming a bridge layer by a plating process may be prevented such that formation of a void may be prevented. The eighth metal layer M8 may be formed by a direct current (DC) electrolytic plating process. For example, the eighth metal layer M8 may be formed on the second metal layer M2 through a plating process by the DC method.

The descriptions of the other elements are substantially the same as in the aforementioned example embodiment, and the detailed descriptions thereof will thus not be provided.

Figure 12:
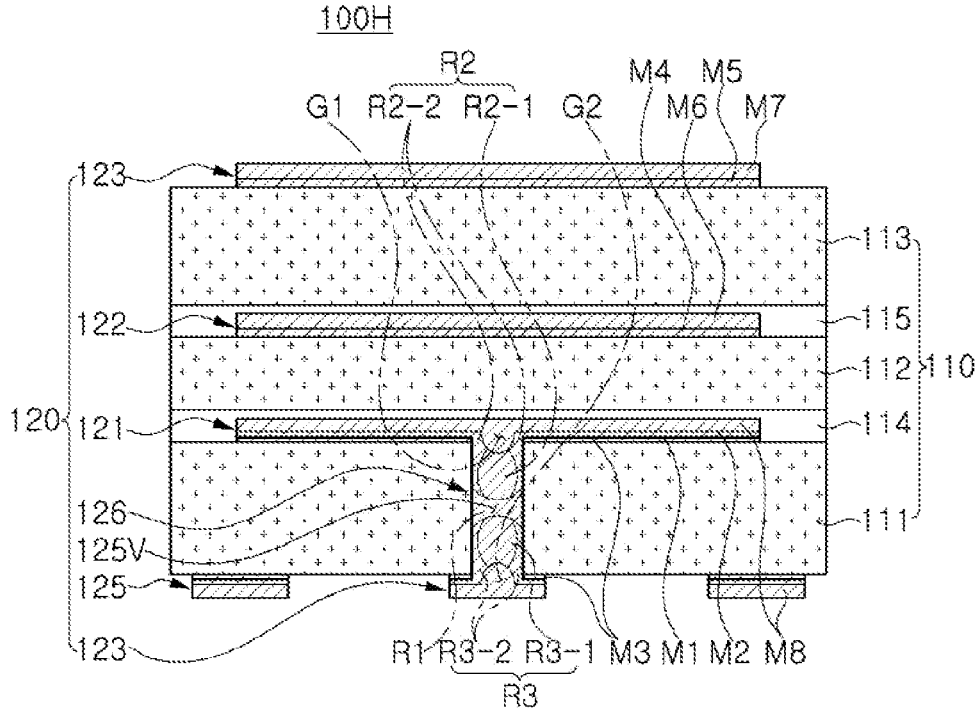
FIG. 12 is a cross-sectional diagram illustrating a modified example of the antenna illustrated in FIG. 11.

FIG. 12 is a cross-sectional diagram illustrating a modified example of the antenna illustrated in FIG. 11.

Referring to the diagram, in an antenna 100H in the modified example embodiment, first and second coupling patterns 122 and 123 may be formed by an MSAP process, differently from the antenna 100A described in the aforementioned example embodiment. Accordingly, the first coupling pattern 122 may include a fourth metal layer M4, a metal foil, or the like, disposed on an upper surface of a second dielectric layer 112, and may further include a sixth metal layer M6 disposed on the fourth metal layer M4. The sixth metal layer M6 may be formed by an electrolytic plating process, and may have a thickness greater than that of the fourth metal layer M4. Also, the second coupling pattern 123 may include a fifth metal layer M5, a metal foil, disposed on an upper surface of the third dielectric layer 113, and may further include a seventh metal layer M7 disposed on the fifth metal layer M5. The seventh metal layer M7 may be formed by an electrolytic plating process, and may have a thickness greater than that of the fifth metal layer M5. The descriptions of the other elements are substantially the same as in the aforementioned example embodiment, and the detailed descriptions thereof will thus not be provided.

Figure 13:
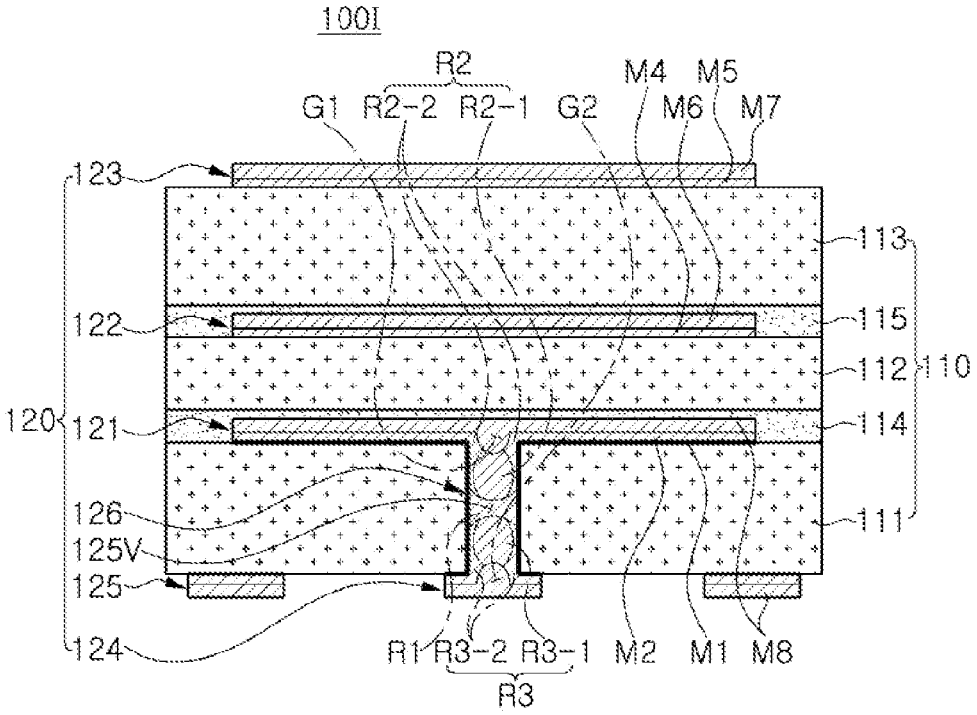
FIG. 13 is a cross-sectional diagram illustrating another modified example of the antenna illustrated in FIG. 11.

FIG. 13 is a cross-sectional diagram illustrating another modified example of the antenna illustrated in FIG. 11.

Referring to the diagram, in an antenna 100I in the modified example embodiment, a patch pattern 121 may be formed by a SAP process, differently from the antenna 100A described in the aforementioned example embodiment. Accordingly, the patch pattern 121 may include a first metal layer M1, a second metal layer M2, and a sixth metal layer M6, and may not include a third metal layer M3. In other words, the patch pattern 121 may be formed by an electroless plating layer and an electrolytic plating layer without a metal foil. Similarly, pad patterns 124 and 125 may include the first metal layer M1, the second metal layer M2, and the sixth metal layer M6, and may not include the third metal layer M3 described above. Also, first and second coupling patterns 122 and 123 may be formed by an SAP. Accordingly, the first coupling pattern 122 may include a fourth metal layer M4, a seed layer formed on an upper surface of a second dielectric layer 112 by an electroless plating process, not a metal foil, and a sixth metal layer M6 formed on the fourth metal layer M4 by an electrolytic plating process based on the fourth metal layer M4. The sixth metal layer M6 may have a thickness greater than that of the fourth metal layer M4. The second coupling pattern 123 may include a fifth metal layer M5, a seed layer formed on an upper surface of a third dielectric layer 113 by an electroless plating process, not a metal foil, and a seventh metal layer M7 formed on the fifth metal layer M5 by an electrolytic plating process based on the fifth metal layer M5. The seventh metal layer M7 may have a thickness greater than that of the fifth metal layer M5. The descriptions of the other elements are substantially the same as in the aforementioned example embodiment, and the detailed descriptions thereof will thus not be provided.

According to the aforementioned example embodiments, an antenna which may increase efficiency and may have a reduced size may be provided.

Also, an antenna which may cover a radio frequency band may be provided.

Further, an antenna which may increase matching properties between patterns formed in different layers may be provided.

In the example embodiments, the terms "side portion," "side surface," and the like, may be used to refer to a surface formed taken in right/left directions with reference to a cross-section in the diagrams for ease of description, the terms "upper side," "upper portion," "upper surfaces," and the like, may be used to refer to a surface formed in an upward direction with reference to a cross-section in the diagrams for ease of description, and the terms "lower side," "lower portion," "lower surface," and the like, may be used to refer to a surface formed in a downward direction. The notion that an element is disposed on a side region, an upper side, an upper region, or a lower resin may include the configuration in which the element is directly in contact with an element configured as a reference in respective directions, and the configuration in which the element is not directly in contact with the reference element. The terms, however, may be defined as above for ease of description, and the scope of right of the example embodiments is not particularly limited to the above terms.

In the example embodiments, the term "connected" may not only refer to "directly connected" but also include "indirectly connected" by means of an adhesive layer, or the like. Also, the term "electrically connected" may include both of the case in which elements are "physically connected" and the case in which elements are "not physically connected." Further, the terms "first," "second," and the like may be used to distinguish one element from the other, and may not limit a sequence and/or an importance, or others, in relation to the elements. In some cases, a first element may be referred to as a second element, and similarly, a second element may be referred to as a first element without departing from the scope of right of the example embodiments.

In the example embodiments, the term "example embodiment" may not refer to one same example embodiment, but may be provided to describe and emphasize different unique features of each example embodiment. The above suggested example embodiments may be implemented do not exclude the possibilities of combination with features of other example embodiments. For example, even though the features described in one example embodiment are not described in the other example embodiment, the description may be understood as relevant to the other example embodiment unless otherwise indicated.

A value used to describe a parameter such as a 1-D dimension of an element including, but not limited to, "length," "width," "thickness," diameter," "distance," "gap," and/or "size," a 2-D dimension of an element including, but not limited to, "area" and/or "size," a 3-D dimension of an element including, but not limited to, "volume" and/or "size", and a property of an element including, not limited to, "roughness," "density," "weight," "weight ratio," and/or "molar ratio" may be obtained by the method(s) and/or the tool(s) described in the present disclosure. The present disclosure, however, is not limited thereto. Other methods and/or tools appreciated by one of ordinary skill in the art, even if not described in the present disclosure, may also be used.

While the example embodiments have been shown and described above, it will be apparent to those skilled in the art that modifications and variations could be made without departing from the scope of the present invention as defined by the appended claims.

What is claimed is:

1. An antenna, comprising:

a first dielectric layer having a first surface and a second surface opposing the first surface;

a second dielectric layer having a third surface, and a fourth surface opposing the third surface;

a third dielectric layer having a fifth surface and a sixth surface opposing the fifth surface;

a first adhesive layer disposed between the second surface and the third surface;

a second adhesive layer disposed between the fourth surface and the fifth surface;

a patch pattern disposed on the second surface and embedded in the first adhesive layer;

a first coupling pattern disposed on the fourth surface and embedded in the second adhesive layer, and a second coupling pattern disposed on the sixth surface, wherein the patch pattern, the first coupling pattern, and the second coupling pattern at least partially overlap one another on a plane, and wherein each of the first and third dielectric layers has a dielectric constant, Dk, greater than a dielectric constant of the second dielectric layer and a dielectric constant of the first adhesive layer.

2. The antenna of claim 1, wherein the second adhesive layer has a dielectric constant, Dk, greater than the dielectric constant of the first adhesive layer.

3. The antenna of claim 1, wherein each of the first to third dielectric layers includes an organic binder and an inorganic filler.

4. The antenna of claim 3, wherein the organic binder includes polytetrafluoroethylene (PTFE), and wherein the inorganic filler includes a ceramic filler.

5. The antenna of claim 3, wherein each of the first to third dielectric layers further includes a woven glass fiber.

6. The antenna of claim 1, wherein each of the first and third dielectric layers has a thickness greater than a thickness of the second dielectric layer, and wherein the thickness of the second dielectric layer is greater than a thickness of each of the first and second adhesive layers.

7. The antenna of claim 1, wherein the patch pattern includes a first metal layer disposed on the second surface and a second metal layer disposed on the first metal layer and having a thickness greater than a thickness of the first metal layer.

8. The antenna of claim 7, wherein the patch pattern further includes a third metal layer disposed between the second surface and the first metal layer and having a thickness greater than the thickness of the first metal layer and less than the thickness of the second metal layer.

9. The antenna of claim 1, wherein the first coupling pattern only includes a fourth metal layer, and wherein the second coupling pattern only includes a fifth metal layer.

10. The antenna of claim 1, wherein the first coupling pattern includes a fourth metal layer disposed on the fourth surface and a sixth metal layer disposed on the fourth metal layer and having a thickness greater than a thickness of the fourth metal layer, and wherein the second coupling pattern includes a fifth metal layer disposed on the sixth surface and a seventh metal layer disposed on the fifth metal layer and having a thickness greater than a thickness of the fifth metal layer.

11. The antenna of claim 1, further comprising:

a first pad pattern disposed on the first surface;

a through-via penetrating the first dielectric layer and connecting the patch pattern to the first pad pattern; and a plurality of second pad patterns disposed on the first surface and surrounding the first pad pattern on a plane.

12. The antenna of claim 11, wherein the through-via includes a first metal layer disposed on a wall of a via hole disposed in the first dielectric layer and a second metal layer disposed on the first metal layer and disposed in the via hole with the first metal layer disposed between the wall of the via hole and the second metal layer.

13. The antenna of claim 12, wherein the second metal layer has first and second dimples in one surface and the other surface, respectively, wherein an average grain size of a metal of the second metal layer in a central region of the via hole is less than an average grain size of a metal in a partial region of one side of the via hole and a partial region of the other side of the via hole, the central region of the via hole disposed between the one side of the via hole and the other side of the via hole, and wherein the through-via further includes an eighth metal layer disposed on the one surface and the other surface of the second metal layer and disposed in the first and second dimples.

14. The antenna of claim 11, wherein the through-via includes a first metal layer disposed on a wall of the via hole formed in the first dielectric layer, a second metal layer conformally disposed on the first metal layer, and an ink layer disposed in the via hole with the second metal layer disposed between the ink layer and the first metal layer.

15. An antenna, comprising:

a first dielectric layer having a first surface and a second surface opposing the first surface;

a second dielectric layer having a third surface, and a fourth surface opposing the third surface;

a third dielectric layer having a fifth surface and a sixth surface opposing the fifth surface;

a first adhesive layer disposed between the second surface and the third surface;

a second adhesive layer disposed between the fourth surface and the fifth surface;

a patch pattern disposed on the second surface and embedded in the first adhesive layer;

a first coupling pattern disposed on the fourth surface and embedded in the second adhesive layer, and a second coupling pattern disposed on the sixth surface, wherein the patch pattern, the first coupling pattern, and the second coupling pattern at least partially overlap one another on a plane, and wherein each of the first to third dielectric layers includes an organic binder and an inorganic filler.

16. The antenna of claim 15, wherein the organic binder includes polytetrafluoroethylene (PTFE), and wherein the inorganic filler includes a ceramic filler.

17. The antenna of claim 15, wherein each of the first to third dielectric layers further includes a woven glass fiber.

18. An antenna, comprising:

a first dielectric layer having a first surface and a second surface opposing the first surface;

a second dielectric layer having a third surface, and a fourth surface opposing the third surface;

a third dielectric layer having a fifth surface and a sixth surface opposing the fifth surface;

a first adhesive layer disposed between the second surface and the third surface;

a second adhesive layer disposed between the fourth surface and the fifth surface;

a patch pattern disposed on the second surface and embedded in the first adhesive layer;

a first coupling pattern disposed on the fourth surface and embedded in the second adhesive layer, and a second coupling pattern disposed on the sixth surface, wherein the patch pattern, the first coupling pattern, and the second coupling pattern at least partially overlap one another on a plane, and wherein the patch pattern includes a first metal layer disposed on the second surface and a second metal layer disposed on the first metal layer and having a thickness greater than a thickness of the first metal layer.

19. The antenna of claim 18, wherein the patch pattern further includes a third metal layer disposed between the second surface and the first metal layer and having a thickness greater than the thickness of the first metal layer and less than the thickness of the second metal layer.

* * * * *